United States Patent [19]

Koev et al.

[11] Patent Number: 4,505,432

[45] Date of Patent: Mar. 19, 1985

[54] METHOD AND DEVICE FOR FINELY GRANULIZING OF STICKY OR AGGLOMERATED MATERIALS USING CONTROLLED VORTICES

[75] Inventors: Koycho G. Koev; Aneliya A. Nedelcheva; Yasmina S. Todorova; Iglika T. Uzunova, all of Varna, Bulgaria

[73] Assignee: Vish-Mahinnoelektritechnicheski Institute, Varna, Bulgaria

[21] Appl. No.: 370,083

[22] Filed: Apr. 20, 1982

[51] Int. Cl.[3] ..... B02C 19/12

[52] U.S. Cl. ..... 241/29; 241/162; 241/257 R

[58] Field of Search ..... 241/257 R, 258, 260, 241/30, 29, 161, 154, 162, 169.1, 261.1, 261

[56] References Cited

U.S. PATENT DOCUMENTS 2,738,930 3/1956 Schneider ..... 241/162

3,434,672 3/1969 Guin ..... 241/257 R X

OTHER PUBLICATIONS

Korda, Pierre, La Production de Particules Très Fines en Génie Chimique, 1-1961.

*Primary Examiner*—Mark Rosenbaum

[57] ABSTRACT

A method and arrangement for multiple stage micronization of sticky material such as clays, sulphur, and pigments is disclosed. The sticky materials are milled by opposing vortices created by high velocity streams of gas or air. Average velocities of at least 60 m/sec are induced within the individual milling chambers by a rapidly rotating rotor and stator acting in different directions. This produces an even stream within the milling chambers, whereby the material being milled travels on a carrier gas without agglomeration. The material to be milled is crumbled within the first milling chamber and transferred to the periphery of the chamber by the main vortices, were a plurality of microvortices disposed tangentially with respect to the main vortex perform the actual milling process. The milled material enters a second milling chamber, and additional chambers thereafter, through a plurality of centripetal channels disposed along a pressure differential. Further milling occurs in these chambers in the same manner as in the first chamber. This method and arrangement for micronization permits milling in a liquid-gas medium.

5 Claims, 3 Drawing Figures

METHOD AND DEVICE FOR FINELY GRANULIZING OF STICKY OR AGGLOMERATED MATERIALS USING CONTROLLED VORTICES

BACKGROUND OF THE INVENTION

This invention relates to a method and device for fine granulization of sticky materials by means of controlled vortices and particularly for micronizing clays, sulphur, pigments, and the like by using controlled vortices of high velocities.

The well-known method for vortical granulization is based on the introduction of a material which has been preliminarily granulated to a given grain size and is then introduced into a tube having a wear resistant inner surface and a defined shape. The material to be milled is thrown onto the inner surface of the tube under the action of a vortex produced by an air compression system. Particles circulate within the milling tube for a time sufficient to achieve the desired level of granulation and then leave the tube for a subsequent separation operation.

The prior art devices based on the aforedescribed method include generally a circular or elliptical tube of ultrahard steel which is provided with tangential peripheral openings for feeding the material to be milled into the tube as well as with compressed gas/air feeding means which produce the vortex, and the material which has been granulated leaves the device through a central or tangential tube or tubes.

The aforedescribed method and the devices based on it have the following disadvantages: a high energy consumption due to the requirement for maintaining both a high velocity and a prolonged contact time between the material to be milled and the gaseous vortex; the unsuitablility of the devices for milling sticky materials due to their tendancy to compact the material within the milling compartment of the tube; the bulkiness and complexity of the equipment and its dependance on other auxiliary system; and finally, heating of the material as a result of its milling.

SUMMARY OF THE INVENTION

It is an object of this invention to provide a method for finely granulizing sticky or agglomerated materials by means of controlled, high velocity vortices of different direction, thereby avoiding both sticking and compacting of the to-be-milled material and insuring a controllable multistage vertical granulation with relative uniformity of the material being milled. The arrangement of the invention is capable of producing vortices of different directions and sizes which have average velocities of at least 60 m/sec in the individual milling chambers, thereby creating conditions for both a good streaming in said chambers and optimal ratios between the material being milled and the carrier-gas so as to avoid compacting or sticking of the grains.

The method according to the invention therefore consists of a multistage milling at a controlled vortexing of the gas stream or air stream.

The material to be milled enters centrally into the first milling chamber where it is maintained by fixed internal projections which cause it to crumble by coacting with movable projections of a rotor to a maximum grain size of 0.4 mm. The particles so crumbled are entrained by the rotor vortices and fall into the periphery of the milling chamber where a plurality of microvortices, forming tangentially to the main vortex, perform the process of milling. Then the material is passed through centripetal channels; then the milled material enters the center of the second milling chamber, said chamber having an equivalent milling effect as the first one. The material is then passed through centripetal channels and then the milled material enters the center of the third milling chamber, etc. The material so milled leaves the last chamber tangentially and is carried away for separation.

The method is implemented by an arrangement which includes a milling device having one, two, three, or more rotors provided with projections and centripetal channels, the latter making a certain angle with the radii of rotors which are mounted on a common shaft. Axial vortex-creating channels separate the individual milling chambers from the rotors mounted on the common shaft and from the cylindrical stator. The stator is shared by all the milling chambers and includes a fixed cover provided with fixed inwardly projecting pins and with an opening for feeding the material to be milled and the gas stream at the front end of the stator. A tangential opening at the back end of the stator, at the last mill chamber, serves for removing the milled material.

The advantages of the method and arrangement of the invention resides in the possibility for micronization of sticky agglomerating or self-compacting materials to be accomplished with a relatively good uniform dispersion of the material so milled and a particle size of less than 5 μm without requiring any auxiliary devices such as vacuum pumps, cooling systems, etc., while operating with a relatively high productivity.

Another advantage resides in utilizing the excess air streaming in the milling chambers for cooling, which enables a low temperature milling.

BRIEF DESCRIPTION OF THE DRAWINGS

The device according to the invention is illustrated by way of example by an embodiment of a two-stage granulation (two milling chambers only) of sticky materials which will be clearly understood in connection with the accompanying drawings, in which.

DETAILED DESCRIPTION

Figure 1:
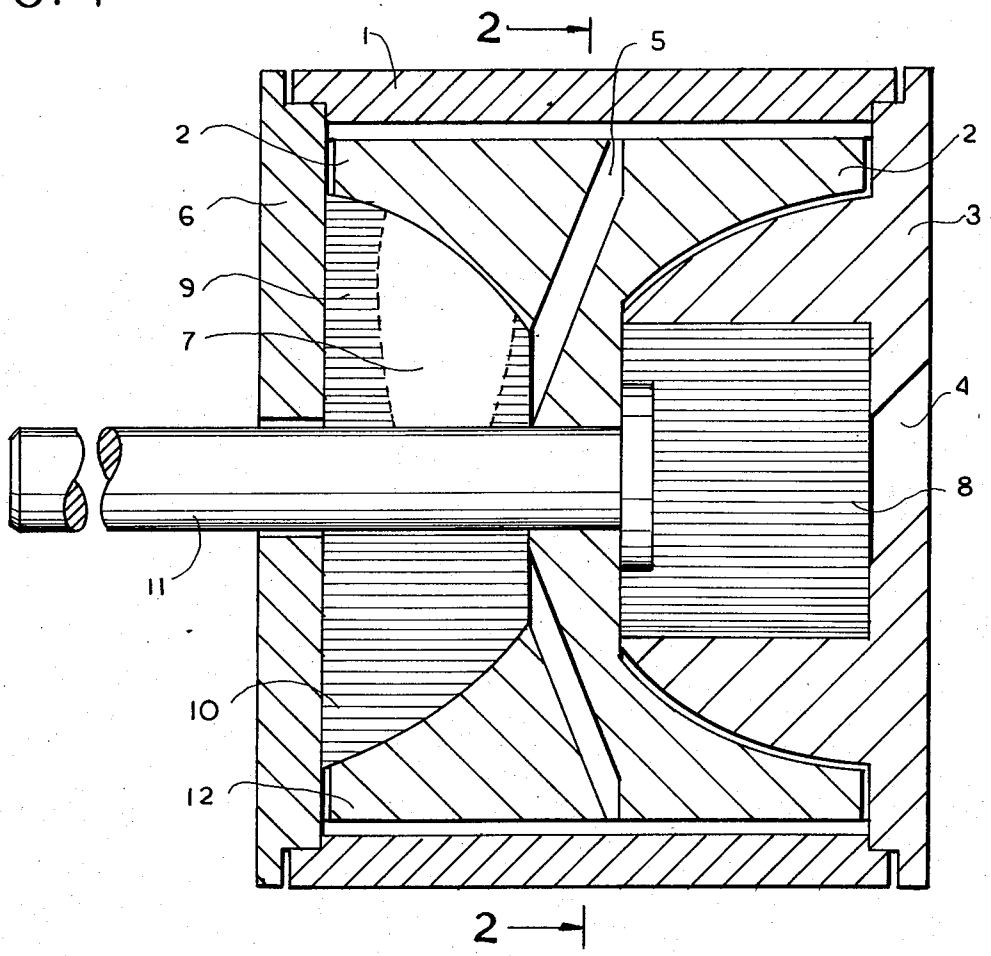
FIG. 1 is a longitudinal sectional view of the assembled arrangement of the invention.
Figure 2:
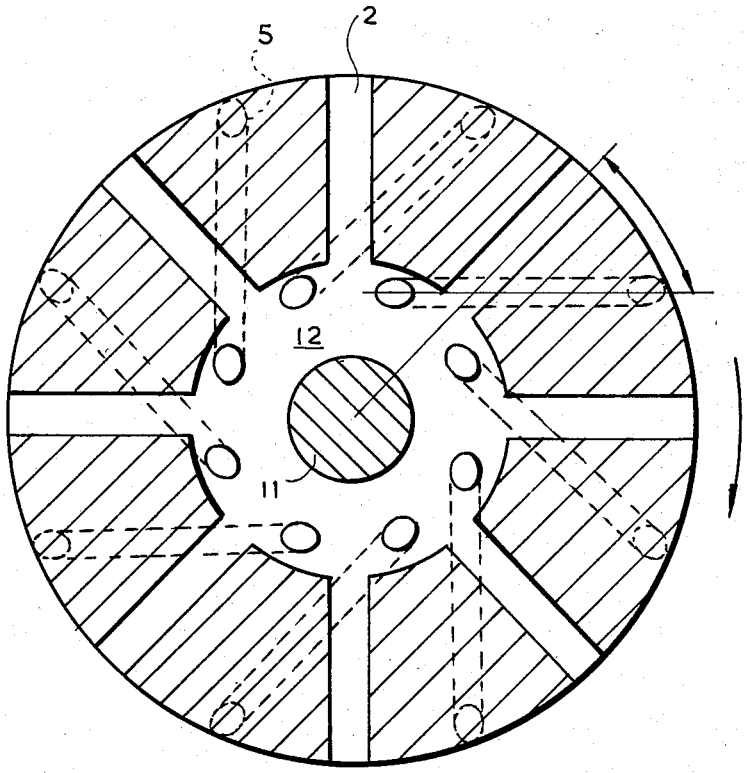
FIG. 2 is a cross-sectional view of the rotor along line 2—2, in which view the stator 1 is not illustrated.
Figure 3:
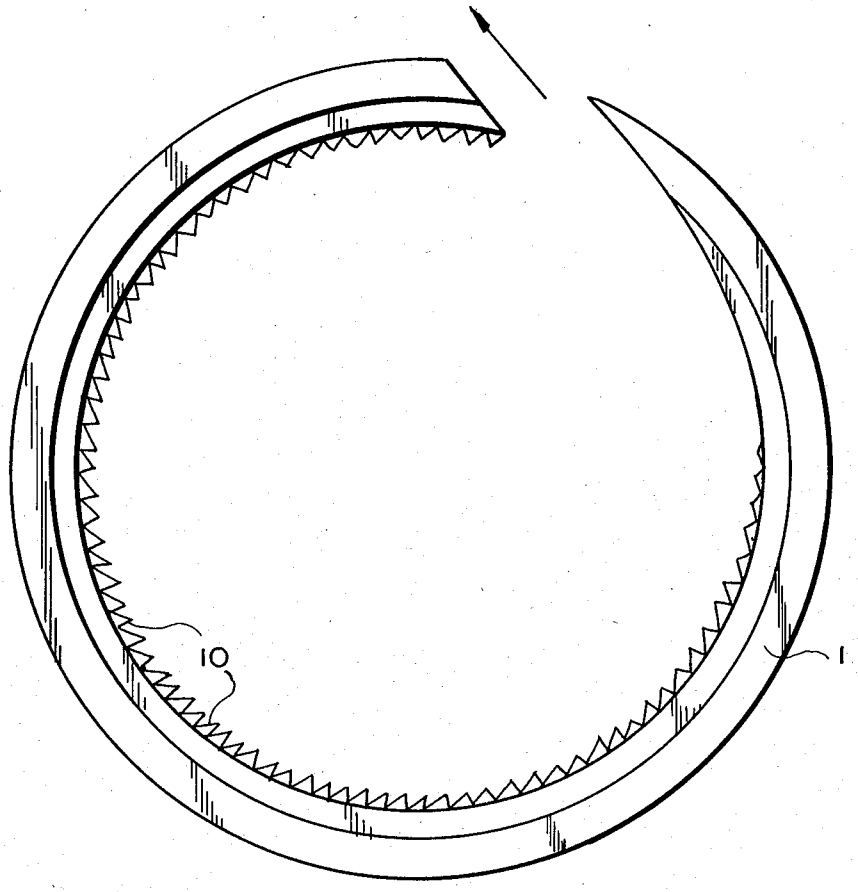
FIG. 3 is an end elevational view of the stator.

The rotor 12 is fixed to a drive shaft 11. The two opposite sides of the rotor are provided with symetrically disposed projections shaped as pins 2. The rotor 2 has a plurality of centripetal channels 5 which are drilled between the pins 2 so as to ensure communication between chambers 8 and 9 disposed at opposite sides of the rotor. The channel 5 makes an angle of 5°-35° with the radius of the rotor 12 in the direction of its rotation. A removable cover 3 is provided with a central feed opening 4 and closes the first milling chamber 8. The other end of the device is closed by the cover 6 in which the axial shaft 11 is rotatably supported.

Axial vortex-creating channels 10 are provided in the stator 1. The second milling chamber 9 is also closed by means of a cover 6. The stator of the milling chamber 9 is provided with a tangentially directed outlet opening 7 wherefrom the material leaves the chamber.

The arrangement of the invention operates as follows: The material which is to be milled enters centrally via feed opening 4 into the first milling chamber 8. The radial distance between the rotor pins 2 and the stator 1 is at most 0.4 mm. The material to be milled is entrapped therebetween and is maintained therebetween until is crumbles to a particle size of less than 0.4 mm. The rotor pins while being rotated exert a vortex action upon the particles so crumbled, thereby carrying said particles into the periphery of the first milling chamber 8, where secondary vortices normal to the main vortex, are created by the axial channels formed in the stator 1. Thereafter, mutual progressive crumbling and granulation of the particles is effected due to the action of the secondary vortices which act in different directions.

The crumbled and granulated material then passes through the centripetal channels 5 from the periphery of the rotor, and this material then enters the center of the second milling chamber 9. Motion of the cylindrical rotor creates a vacuum at its center and pressure at its periphery. The channels link the high pressure region of milling chamber 8 with the low pressure region of milling chamber 9. The pressure differential creates a stream in the carrier gas which moves the partially milled material from one chamber to the next. The second milling chamber represents a mirror image of the first one. The premilled material is then transported from the center of the second milling chamber by the vortices formed therein so as to be carried into the periphery of the stator 1 where additional milling occurs due to the secondary vortices created in a manner similar to that for the first chamber. After being further milled, the material leaves the last milling chamber 9 through the tangential outlet opening 7.

As a result of the pumping effect created in the individual milling chambers (i.e. overpressure at the rotor periphery and subpressure at the center of the arrangement), the air stream which carries the material to be milled is directed at a high velocity in the form of a cyclone which passes through the outlet 7 of the last stage, thereby creating a sufficient pressure so as to ensure the separtation of the particles in said cyclone.

The volume ratios between material and carrier air are from 1:500 up to 1:10,000. the peripheral speed the rotor driven by the shaft 11 is of from 60 up to 200 m/sec.

No sticking, compacting or heating of the material is observed with the method and arrangement outlined above.

The granulometry of material milled in accordance with the invention is as follows: 80% of particles sizes up 2 μm about 10% of particle sizes in the range of from 2 μm up to 5 μm and 10% of particles sizes over 5 μm.

Although the invention is illustrated and described with reference to one preferred embodiment thereof, it is to be expressly understood that it is in no way limited to the disclosure of such a preferred embodiment, but is capable of numerous modifications within the scope of the appended claims.

REFERENCES

Pierre Korda, Le production de particules tres fines en Genie chimique, Paris, 1961.

We claim:

1. A method for finely granulating sticky and/or agglomerated material by means of controlled vortices, comprising the steps of feeding a sticky and/or agglomerated material centrally of a first inlet milling chamber of an arrangement comprising a cylindrical stator and a rotor axially rotatably disposed therein which divides the stator into first and second milling chambers;

crumbling said material in said first milling chamber to a particle size of about 0.4 mm;

transporting the so crumbled material by means of a main vortex produced by the coaction of the rotating rotor and stator to a plurality of microvortices simultaneously produced at the periphery of the rotating rotor by said coaction to thereby finely granulize the crumbled material; said granulation being effected at the interfaces between the main vortex and the plurality of peripheral vortices; and thereafter transporting said finely granulated material to the second milling chamber for further granulization.

2. The method for finely granulating sticky and/or agglomerated material as set forth in claim 1, including transporating said granulated material from said first to said second milling chamber via a plurality of centripetal channels angularly disposed along a pressure differential within said rotor.

3. The method for finely granulating sticky and/or agglomerated material as set forth in claim 2, including carrying out said granulization step in more than two stages.

4. An arrangement for finely granulating sticky and/or agglomerated material by means of controlled vortices, comprising in combination, a cylindrical stator having a plurality of longitudinal extending parallel uniformly circumferentially spaced axially inward projections;

a rotor coaxially rotatably mounted in said satator via a drive shaft;

a pair of opposite end walls mounted on said stator, one of said end walls rotatably supporting said drive shaft and the other end wall having a centrally disposed feed opening;

said rotor having a plurality of symmetrical and uniformly circumferentially spaced axially outward projections the peripheries of which are adapted to coact with said axially inward projections to produce a plurality of secondary peripheral vortices;

said rotor having at least one centripetally extending channel disposed along a pressure differential and between each adjoining pair of axially outward projections which makes an angle of 5° to 35° with the radius of the rotor in the direction of rotation.

5. The arrangement for finely granulating sticky and/or agglomerated material as set forth in claim 4, wherein the maximum distance between said radially inward and outward projections is 0.4 mm.

* * * * *